US010273434B2

(12) United States Patent
Lambert et al.

(10) Patent No.: US 10,273,434 B2
(45) Date of Patent: Apr. 30, 2019

(54) PROTECTION OF THE COLOR OF TEXTILE FIBERS BY MEANS OF CATIONIC POLYSACCHRIDES

(71) Applicant: RHODIA OPERATIONS, Paris (FR)

(72) Inventors: Florence Lambert, Paris (FR); Celine Orizet, Bourg la Reine (FR)

(73) Assignee: Rhodia Operations, Paris (FR)

( * ) Notice: Subject to any disclaimer, the term of this patent is extended or adjusted under 35 U.S.C. 154(b) by 0 days.

(21) Appl. No.: 15/227,124

(22) Filed: Aug. 3, 2016

(65) Prior Publication Data

US 2016/0340615 A1 Nov. 24, 2016

Related U.S. Application Data

(63) Continuation-in-part of application No. 13/704,952, filed as application No. PCT/EP2011/057944 on May 17, 2011, now abandoned.

(30) Foreign Application Priority Data

Jun. 18, 2010 (FR) ..... 10 54874

(51) Int. Cl.

| | |
|---|---|
| ***D06F 35/00*** | (2006.01) |
| ***D06L 1/00*** | (2017.01) |
| ***C11D 11/00*** | (2006.01) |
| ***C11D 3/22*** | (2006.01) |
| ***C11D 3/00*** | (2006.01) |

(52) U.S. Cl.
CPC ..... *C11D 3/0021* (2013.01); *C11D 3/227* (2013.01)

(58) Field of Classification Search
None
See application file for complete search history.

(56) References Cited

U.S. PATENT DOCUMENTS

| | | | | |
|---|---|---|---|---|
| 3,589,578 | A | 6/1971 | Kamphausen | |
| 4,031,307 | A | 6/1977 | DeMartino et al. | |
| 4,179,382 | A * | 12/1979 | Rudkin | C11D 3/0015 510/521 |
| 4,289,642 | A * | 9/1981 | Weber | C11D 3/227 510/317 |
| 5,698,476 | A | 12/1997 | Johnson et al. | |
| 6,492,322 | B1 * | 12/2002 | Cooper | C11D 1/62 510/516 |
| 6,541,614 | B1 * | 4/2003 | Nagasawa | A61K 8/73 536/123.1 |
| 6,833,347 | B1 | 12/2004 | Jiping et al. | |
| 6,869,923 | B1 | 3/2005 | Cunningham et al. | |
| 7,005,410 | B2 | 2/2006 | Trinh et al. | |
| 7,335,630 | B2 | 2/2008 | Delplancke et al. | |
| 2003/0054966 | A1 | 3/2003 | Bone et al. | |
| 2004/0067864 | A1 | 4/2004 | Aubay et al. | |
| 2004/0142840 | A1 | 7/2004 | De Buzzaccarini et al. | |
| 2005/0256024 | A1 * | 11/2005 | Barry | C11D 3/373 510/466 |
| 2006/0030513 | A1 | 2/2006 | Binder et al. | |
| 2006/0122094 | A1 * | 6/2006 | Fabicon | C11D 1/008 510/521 |
| 2006/0217288 | A1 * | 9/2006 | Wahl | C11D 3/0015 510/515 |
| 2008/0076692 | A1 | 3/2008 | Carvell et al. | |
| 2008/0242584 | A1 * | 10/2008 | Wahl | C11D 3/227 510/517 |
| 2009/0281011 | A1 | 11/2009 | Mayer et al. | |
| 2010/0056420 | A1 | 3/2010 | Corona, III et al. | |

FOREIGN PATENT DOCUMENTS

| | | | |
|---|---|---|---|
| WO | 0130951 | A1 | 5/2001 |
| WO | 2006099963 | A1 | 9/2006 |
| WO | 2009099567 | A2 | 8/2009 |
| WO | 2010014219 | A1 | 2/2010 |

* cited by examiner

*Primary Examiner* — Lorna M Douyon

(57) ABSTRACT

The present invention relates to the use of a cationic polysaccharide in a detergent composition used for treating dyed textile fibers in an aqueous medium, in order to reduce the loss of color of the dyed fibers when treating same using said detergent composition.

5 Claims, No Drawings

PROTECTION OF THE COLOR OF TEXTILE FIBERS BY MEANS OF CATIONIC POLYSACCHRIDES

CROSS-REFERENCE TO RELATED APPLICATIONS

This application is a continuation in part of, and claimed benefit to, U.S. Utility patent application Ser. No. 13/704,952, filed May 3, 2013, now abandoned which is the U.S. National Phase of International Application No. PCT/EP2011/057944 filed on May 17, 2011, which claims priority to French Application No. FR 1054874, filed Jun. 18, 2010. All such applications are incorporated herein by reference in their entireties.

FIELD OF THE INVENTION

The present invention relates to the field of laundry products.

The expression "laundry products" is understood, within the meaning of the present description, to mean the compositions intended for the treatment of textile articles in an aqueous medium, which include in particular detergent, rinsing and/or softening compositions and washing additives, which are used for hand washing or for machine washing.

The invention relates more specifically to a method that makes it possible to prevent color loss from dyed textile fibers when the latter are treated in an aqueous medium with laundry products of the aforementioned type, in particular during a machine washing or rinsing cycle.

During a treatment, in an aqueous medium, of textile articles which comprise dyed fibers, in particular fibers dyed by pigments, a more or less pronounced fading phenomenon of the fibers is often observed. In particular, hand or machine washing and rinsing and the rinsing of dyed textile articles may lead to color loss, especially by entrainment of some of the pigments into the washing or rinsing waters.

SUMMARY OF THE INVENTION

One objective of the present invention is to provide a method that makes it possible to reduce this color loss phenomenon observed during a treatment in an aqueous medium of dyed textile fibers, in particular of fibers dyed by pigments, so as to preserve the colors of the fibers.

For this purpose, the present invention proposes the use of a new type of additive within laundry products, namely a cationic polymer.

More specifically, one subject of the present invention is the use, in a laundry product used for treating dyed textile fibers in an aqueous medium (in general for treating woven or nonwoven textile articles comprising such dyed fibers), of a cationic polysaccharide for reducing color loss from dyed fibers during the treatment thereof by said laundry product.

DETAILED DESCRIPTION OF THE PREFERRED EMBODIMENTS

Within the context of the present invention, the inventors have now demonstrated that the addition of a cationic polysaccharide within a laundry product makes it possible to reduce the color loss phenomenon during the treatment of dyed fibers by the laundry product in an aqueous medium, with respect to a treatment under the same conditions but in the absence of cationic polysaccharide. The presence of the cationic polysaccharides proves to limit (or even almost completely inhibit in certain cases) the color fading effect of the textile fibers, which makes it possible to maintain an acceptable quality of the dyed fabrics after washing.

The studies that were carried out by the inventors within the context of the invention make it possible to suggest that this effect is at least partly explained by the fact that the cationic polysaccharides retain in the textile fibers all or some of the dyes or pigments which, in the absence of the cationic polysaccharides, have a tendency to be desorbed during the treatment with the laundry product (via entrainment into the aqueous treatment medium, which induces as it were a "bleeding" of these dyes or pigments).

The color-protecting effect which is obtained within the context of the present invention makes it possible to limit the color loss phenomenon for most dyed fibers that are colored by dyes and pigments commonly used in the field of the textile industry and which tend to bleed in the absence of the use of the cationic polysaccharides according to the invention.

The color-protecting effect obtained according to the invention, which makes it possible to maintain the color in dyed textile fibers and prevents the desorption thereof, is in addition accompanied by another significant advantage, namely that it makes it possible to avoid another common problem during washing operations carried out on dyed textiles, namely the transfer of colors from one article to another, that it is very particularly sought to prevent in order to preserve the appearance of the textiles.

The color-protecting effect obtained according to the invention proves to be appreciable since the dye or pigment that it is desired to retain on the textile fiber has a tendency to be eliminated during treatment by a laundry product and since the treatment carried out is likely to induce a desorption of the dyes and pigments present on the fibers.

The use of cationic polysaccharides according to the invention makes it possible, especially, to effectively retain in dyed fibers the pigments of the type of those which are present in the set of dyed monitors known as AISE 40 color dye set which is recommended by A.I.S.E. (Association Internationale de la Savonnerie, de La Détergence et des Produits d'Entretien) [International Association for Soaps, Detergents and Maintenance Products] in order to test the color retention on certain fabrics.

Typically, the method of the present invention proves advantageous for preventing the fading of textile fibers dyed with compounds selected from the pigments and dyes known as "Sulphur Black", "Vat Green", "Vat Brown", "Vat Blue", "Vat Yellow", "Azoic Orange", "Direct Yellow", "Direct Black", "Direct Rubine", "Reactive Red", "Reactive Red B", "Reactive Red C", "Reactive Red D", "React. Black", "React. Orange", "Reactive Green", "Reactive Blue", "Reactive Blue B", "React. Violet", "Trichromate Dye", "Trichromate Oxi Dye", "Disperse Red", "Disperse Navy", "Disperse Red B", "Disperse Blue", "Acid Brown", "Acid Red", "Chromium Red", "Acid Red" and "Chromium Black".

The method of the invention proves very suitable for ensuring the color protection of most textile fibers, in particular that are dyed with dyes of the aforementioned type, especially cotton, polyester, Polyacryl® or Nylon® fibers, by inhibiting the desorption phenomena of the pigments out of these fibers during the treatment thereof with a laundry product.

The cationic polysaccharides used according to the invention thus prove, in particular, effective for inhibiting the fading of dyed cotton fibers, especially cotton fibers dyed with the dyes "Sulphur Black", "Reactive Red" and/or "Vat Blue" of the type of the aforementioned AISE 1, AISE 5 and AISE 16 compositions from the AISE 40 color dye set.

Especially to obtain, according to the invention, a sufficiently pronounced color-protecting effect, it is preferable for the cationic polysaccharide to be used in an amount sufficient to enable action over all of the dyed textile fibers subjected to the treatment with the laundry product. For this purpose, it usually proves desirable for the polysaccharide to be used in an amount such that its concentration within the aqueous medium where the fibers are treated (washing liquor, rinsing waters, for example) is at least 0.005 g/l, more preferably at least 0.01 g/l, amounts exceeding 1 g/l not generally being required. Thus, for example, the concentration of cationic polysaccharide within the aqueous medium where the fibers are treated may advantageously range from 0.01 to 0.5 g/l, for example from 0.02 to 0.1 g/l, in particular of the order of 0.05 g/l.

In particular to achieve such concentrations in the medium for treating the fibers, the cationic polysaccharide used according to the invention is preferably added to the laundry product in a proportion of at least 0.1%, and preferably in a proportion of at least 0.2% by weight, relative to the weight of the laundry product. In order to obtain the desired effect, the cationic polysaccharide does not generally need to be present in high proportions, and it is typically used in a proportion of less than 15%, or even less than 10% by weight relative to the weight of the laundry product. Thus, it often proves advantageous for the cationic polysaccharide to be used in an amount ranging from 0.5% to 3% (for example from 0.8% to 2%, especially around 1%) by weight relative to the weight of the laundry product.

Typically, the cationic polysaccharide of use according to the invention is used as an additive in the laundry product, in which case the percentages by weight expressed above are calculated by weight of additive relative to the weight of the remainder of the composition.

According to another embodiment, the cationic polysaccharide may be introduced into a separate composition, added to the laundry product at the time of treating the dyed fibers with this laundry product. In this case, the percentages by weight expressed above are calculated by weight of additive present in the separate composition relative to the weight of the laundry product.

The laundry product used within the context of the present invention and with respect to which the cationic polysaccharide provides color protection may be selected from any machine-washing or hand-washing laundry product, whether it is for industrial or domestic use. This product may thus be, for example, a hand-washing or machine-washing laundry product, selected from a detergent composition, optionally in combination with a washing additive, a prewash laundry stain remover (prespotting) composition, a rinsing composition and/or a softening composition. It may be a liquid or solid composition or product.

The use of the cationic polysaccharides according to the invention proves very particularly well suited to color protection during the washing of textile articles based on dyed textile fibers, with detergent compositions, optionally in combination with a washing additive, very particularly during machine washing where the fading effect is generally noticeable in the absence of the cationic polysaccharides used according to the invention.

The laundry product used within the context of the present invention and with respect to which the cationic polysaccharide provides color protection is preferably a composition that is free of anionic compounds capable of interacting with the cationic polysaccharides, which would otherwise harm their effectiveness. Preferably, the laundry product used according to the invention in combination with the cationic polysaccharide is free of any anionic compound or at the very least comprises a small amount of anionic compounds (less than 0.1%, or even less than 0.05% by weight typically). However, the implementation of the invention can be envisaged with certain laundry products comprising agents of anionic nature.

Mention may especially be made, as a laundry product that is very suitable within the context of the implementation of the present invention, of detergent compositions in powder form, washing additives and rinsing compositions and softeners, preferably that are free of anionic compounds.

A color-protecting effect according to the invention is generally obtained relatively effectively under most standard conditions for treating textile articles during hand-washing or machine-washing operations. Thus, the treatment of the dyed fibers according to the invention, and generally of textile articles based on these dyed fibers, may typically be carried out at a temperature ranging from 25° C. to 90° C., preferably from 30° C. to 60° C. This treatment may furthermore be carried out over a time typically ranging from 10 minutes to 2 hours, for example between 20 minutes and one hour. Furthermore, the color retention is ensured, including with spinning speeds of between 50 and 1000 rpm, in particular between 75 and 500 rpm.

The cationic polysaccharides which are used within the context of the present invention may, generally, be selected from polymers having a polysaccharide backbone comprising cationic groups, of the type of those described, for example, in patents U.S. Pat. Nos. 3,589,578 and 4,031,307. Preferably, the cationic groups borne by the cationic polysaccharides used according to the invention are non-polymer groups. Furthermore, the concept of cationic group excludes, within the meaning of the present description, groups of zwitterionic nature.

These cationic polysaccharides are polymers obtained by chemically modifying polysaccharides, generally natural polysaccharides such as cellulose or guar gum. This chemical modification, also known as "derivatization", makes it possible to introduce side groups into the polysaccharide backbone, in general that are bonded via ether bonds where the oxygen atom of the ether bond corresponds to the hydroxyl groups of the backbone of the polysaccharide that has reacted for the modification.

Preferably, the cationic groups borne by the cationic polysaccharides of use according to the invention are, or at the very least comprise, quaternary ammonium groups.

According to one advantageous embodiment, the cationic polysaccharides used according to the invention are selected from cationic celluloses and cationic guars. More advantageously still, they are cationic guars (guar gums containing cationic groups).

The cationic celluloses are celluloses modified by cationic groups. These celluloses may in particular be cellulose ethers of the type described, for example, in U.S. Pat. No. 6,833,347.

Cationic celluloses (cationic derivatives of cellulose) that can be used within the context of the invention are celluloses modified by quaternary ammonium cationic groups, typically bearing three, identical or different, radicals selected from hydrogen, an alkyl radical comprising 1 to 10 carbon atoms, more particularly 1 to 6, advantageously 1 to 3 carbon atoms, these three radicals preferably all three being identical or different alkyl radicals. Typically, the quaternary ammonium groups are trialkylammonium radicals, such as trimethylammonium, triethylammonium and tributylammonium radicals, aryldialkylammonium radicals, especially benzyldimethylammonium radicals, and/or ammonium radicals in which the nitrogen atom is a member of a cyclic structure, such as pyridinium and imidazoline radicals, each in combination with a counterion, especially chloride. The counterion of the quaternary ammonium group is generally a halide, such as a chloride ion, or alternatively a bromide or iodide.

As cationic celluloses according to the invention, the cationic derivatives of cellulose selected from trimethylammonium-3-propyl cellulose poly(1,2-oxy-ethanediyl)-2-hydroxy ether chloride or polyquaternium-(PQ10) prove to be particularly suitable. Mention may also be made of the Ucare® products sold by Dow. Among these, mention may preferably be made of the polymers Ucare® JR 30M, Ucare® JR 400, Ucare® JR 125, Ucare® LR 400 and Ucare® LK 400.

The cationic guars that can be used within the context of the invention are cationic derivatives of guar, advantageously guars modified by quaternary ammonium cationic groups, typically bearing three, identical or different, radicals selected from hydrogen, an alkyl radical comprising 1 to 22 carbon atoms, more particularly 1 to 14, advantageously 1 to 3 carbon atoms, these three radicals preferably all three being identical or different alkyl radicals. Preferably, the cationic guars used according to the invention are guars modified by one or more cationic groups comprising trialkylammonium radicals, such as trimethylammonium, triethylammonium and tributylammonium radicals, aryldialkylammonium radicals, especially benzyldimethylammonium radicals, and ammonium radicals in which the nitrogen atom is a member of a cyclic structure, such as pyridinium and imidazoline radicals, each in combination with a counterion, especially chloride, bromide or iodide.

Cationic guars that are very suitable for the implementation of the invention are modified guars obtained, for example, according to the "derivatization" techniques described for example in international applications WO 2009/099567 and WO 2010/014219.

Within this context, use may especially be made of guars modified by a derivatization agent comprising a cationic substituent that comprises a cationic nitrogen-containing radical, more particularly a quaternary ammonium radical.

In certain embodiments, the cationic group present on a cationic guar is bonded to the reactive functional group of the cationizing agent, for example via an alkylene or oxyalkylene binding group. Suitable cationizing groups comprise, for example, cationic nitrogen-containing compounds functionalized by epoxys, such as for example 2,3-epoxypropyltrimethylammonium chloride compounds, cationic nitrogen-containing compounds functionalized by chlorine, such as for example 3-chloro-2-hydroxypropyltrimethylammonium chloride, 3-chloro-2-hydroxylpropyllauryldimethylammonium chloride, 3-chloro-2-hydroxypropylstearyldimethylammonium chloride; and nitrogen-containing compounds with vinyl or (meth)acrylamide functions, such as methacrylamido-propyltrimethylammonium chloride.

The cationic groups used for modifying the guars may, for example, be hydroxypropylammonium groups. These may be obtained, for example, by reacting the guar gum with compounds such as 2,3-epoxypropyltrimethylammonium chloride or 3-chloro-2-hydroxypropyltrimethylammonium chloride.

Thus, as cationic guars that are very suitable according to the invention, mention may be made of the guars denoted, according to INCI terminology, under the name Guar Hydroxypropyltrimonium Chloride. Particular examples of these guars are especially the Rhodia products Jaguar® C17 and Jaguar® C13S, sold by the company Rhodia.

More generally, as cationic polysaccharides that are advantageous for the implementation of the present invention, mention may especially be made of the following commercial products: Jaguar® C-500 (guar hydroxypropyltrimonium chloride) sold by the company Rhodia, Jaguar® C-162 (hydroxypropyl guar hydroxypropyltrimonium chloride) sold by the company Rhodia, Polycare® 400 (polyquaternium-10) sold by the company Rhodia and Ucare® JR-400 (polyquaternium-10) sold by the company Dow-Amerchol.

According to one particularly advantageous embodiment of the present invention, the cationic polysaccharide used for ensuring the color-protecting effect is a cationic guar, which is preferably chosen from the products Jaguar® C-500 and Jaguar® C-162 mentioned above. The product Jaguar® C-500 is particularly preferred within the context of the present invention. Irrespective of the exact nature of the cationic polysaccharide used according to the invention, its molecular weight is preferably between 20 000 and 5 000 000 $g \cdot mol^{-1}$, for example between 100 000 and 1 000 000 $g \cdot mol^{-1}$. More particularly, the molecular weight of the cationic polymer used within the context of the present invention is less than 500 000 $g \cdot mol^{-1}$.

According to one preferred embodiment, the cationic polysaccharide used according to the invention may be a cationic guar, preferably a guar hydroxypropyltrimonium chloride, having an average molecular weight between 300 000 and 650 000 g/mol, for example between 350 000 and 500 000 g/mol, and having a degree of cationic substitution (DScat) between 0.08 and 0.12, for example between 0.09 and 0.11.

The expression "average molecular weight" is understood to mean the weight-average molecular weight. This can be measured by GPC via a light scattering detection. A value of 0.140 for do/dc is used for the molecular weight calculation. A Wyatt MALS detector is calibrated using a 22.5 kDa polyethylene glycol standard. All the calculations of the molecular weight distributions are carried out using Wyatt's ASTRA software. The samples are prepared in the form of 0.05% solutions in the mobile phase (100 mM $Na_2SO_4$, 100 mM $H_3PO_4$) and filtered through 0.45 μm PVDF filters before analysis.

The expression "degree of cationic substitution" is understood to mean the average number of moles of cationic groups per mole of sugar unit. This value may be measured by $^1$H-NMR (solvent: $D_2O$ or DMSO).

The invention will be even further illustrated by means of the examples below, in which the effects of cationic polysaccharides on the color protection are demonstrated during washing cycles using detergent compositions.

EXAMPLES

In the examples 1-2 below, a Jaguar® C-500 cationic guar (molecular weight=300 000-500 000 $g \cdot mol^{-1}$; DS=0.08-0.11) was used in order to ensure the stabilization of the color of dyed cotton pieces during the machine washing thereof.

In order to do this, the cationic guar was added to a detergent composition (X-TRA® washing powder) in a proportion of 1% by weight relative to the weight of the washing powder, then several successive cycles of washing fabrics based on dyed fibers using this additive-containing composition were carried out, under the conditions below. In certain cases (example 2) the washing was carried out by adding, in addition, a washing additive (Vanish® powder composition).

There types of samples of dyed fabrics were subjected to the washing cycles, which fabrics are based on cotton fibers dyed by pigments, namely:

black on cotton: AISE 1 Sulphur Black red on cotton: AISE 16 Reactive Red blue on cotton: AISE 5 Vat Blue The washing cycles of these fabrics were carried out in a tergotometer, of the type that is standard in the field of the formulation of laundry products, especially detergent compositions. The machine simulates the mechanical and thermal effects of American pulsator type washing machines, but has 6 washing vessels (containers), which makes it possible to carry out series of simultaneous tests with a timesaving. The washing cycles were carried out under the following conditions:

Experimental Conditions

In each container of the tergotometer:

volume of tap water: 1000 ml 5 pieces of dyed fabrics (clean fabrics of the same color)

detergent composition: 5 g/l washing temperature: 40° C.

washing time: 30 minutes spinning: 100±3 cycles/min rinsing: two times 5 minutes at 20° C. in tap water drying conditions: at ambient temperature For each case, 10 successive washing cycles were carried out and the color change obtained for the fabrics was quantified at the end of the first, third, fifth and tenth cycle.

Measurement of the change was quantified using a KONICA Minolta CM-2600d spectrocolorimeter.

The color variation is quantified using the CIELAB (L*a*b*) scale and by measuring the color difference in terms of ΔL (lightness), Δa (red), Δb (yellow) according to a method that is well known per se, which makes it possible to attain the measurement of the total color difference ΔE (10°/illuminant D65), calculated as follows:

$$\Delta E=\sqrt{\Delta L^2+\Delta a^2+\Delta b^2}$$

where: $\Delta L=L_{after\ washing}-L_{before\ washing}$ $\Delta a=a_{after\ washing}-a_{before\ washing}$ $\Delta b=b_{after\ washing}-b_{before\ washing}$ The ΔE measurement reflects the change in the color during washing. The higher this value, the more pronounced the color difference.

Example 1: Results with the X-TRA® Washing Powder Alone

Tests were carried out with the red, blue and black colors and the results obtained after 1, 3, 5 and 10 washing cycles are indicated in tables 1, 2, 3 and 4 below.

TABLE 1

| 1 washing cycle | | | |
|---|---|---|---|
| | | Average Δe | |
| | Color | without cationic polymer | with cationic polymer |
| Test 1 | Black | 3.2 | 3.2 |
| Test 2 | | 3.2 | 3.2 |
| Test 3 | Blue | 2.4 | 3.2 |

TABLE 1-continued

| 1 washing cycle | | | |
|---|---|---|---|
| | | Average Δe | |
| | Color | without cationic polymer | with cationic polymer |
| Test 4 | | 1.9 | 3.4 |
| Test 5 | Red | 2.6 | 1.4 |
| Test 6 | | 2.6 | 1.4 |
| | Combined average ΔE for 3 colors | 8.0 | 7.9 |

TABLE 2

| 3 washing cycles | | | |
|---|---|---|---|
| | | Average Δe | |
| | Color | without cationic polymer | with cationic polymer |
| Test 1 | Black | 4.9 | 4.4 |
| Test 2 | | 4.9 | 4.3 |
| Test 3 | Blue | 3.6 | 4.5 |
| Test 4 | | 4 | 4.2 |
| Test 5 | Red | 4.7 | 3.3 |
| Test 6 | | 4.3 | 3.3 |
| | Combined average ΔE for 3 colors | 13.2 | 12.0 |

TABLE 3

| 5 washing cycles | | | |
|---|---|---|---|
| | | Average Δe | |
| | Color | without cationic polymer | with cationic polymer |
| Test 1 | Black | 7.6 | 5.8 |
| Test 2 | | 7.4 | 5.7 |
| Test 3 | Blue | 3.5 | 4.3 |
| Test 4 | | 3.6 | 4.3 |
| Test 5 | Red | 4.7 | 4.0 |
| Test 6 | | 4.5 | 3.7 |
| | Combined average ΔE for 3 colors | 15.7 | 13.9 |

TABLE 4

| 10 washing cycles | | | |
|---|---|---|---|
| | | Average Δe | |
| | Color | without cationic polymer | with cationic polymer |
| Test 1 | Black | 13.6 | 10.5 |
| Test 2 | | 13.2 | 10.2 |
| Test 3 | Blue | 3.3 | 4.6 |
| Test 4 | | 3.9 | 4.0 |
| Test 5 | Red | 7.4 | 4.4 |
| Test 6 | | 6.4 | 4.3 |
| | Combined average ΔE for 3 colors | 23.9 | 19.0 |

The above tables clearly show a significant reduction in ΔE when the washing powder is combined with Jaguar® C-500 compared to the use of the washing powder alone.

Example 2: Results with the X-TRA® Washing Powder and Vanish® Powder

Tests were carried out with the red, blue and black colors and the results obtained after 1, 3, 5 and 10 washing cycles are indicated in tables 5, 6, 7 and 8 below.

TABLE 5

| 1 washing cycle | | | |
|---|---|---|---|
| | | Average Δe | |
| | Color | without cationic polymer | with cationic polymer |
| Test 1 | Black | 5.5 | 3.8 |
| Test 2 | | 5.7 | 3.8 |
| Test 3 | Blue | 3.7 | 3.4 |
| Test 4 | | 3.4 | 3.5 |
| Test 5 | Red | 2.5 | 2.5 |
| Test 6 | | 3.6 | 2.2 |
| | Combined average ΔE for 3 colors | 12.1 | 9.6 |

TABLE 6

| 3 washing cycles | | | |
|---|---|---|---|
| | | Average Δe | |
| | Color | without cationic polymer | with cationic polymer |
| Test 1 | Black | 11.3 | 8.0 |
| Test 2 | | 11.8 | 8.1 |
| Test 3 | Blue | 5.4 | 4.6 |
| Test 4 | | 5.4 | 4.8 |
| Test 5 | Red | 4.5 | 3.4 |
| Test 6 | | 4.9 | 3.5 |
| | Combined average ΔE for 3 colors | 21.6 | 16.2 |

TABLE 7

| 5 washing cycles | | | |
|---|---|---|---|
| | | Average Δe | |
| | Color | without cationic polymer | with cationic polymer |
| Test 1 | Black | 15.9 | 13.4 |
| Test 2 | | 16.9 | 13.0 |
| Test 3 | Blue | 6.1 | 5.2 |
| Test 4 | | 6.1 | 5.0 |
| Test 5 | Red | 5.5 | 3.6 |
| Test 6 | | 6.6 | 4.2 |
| | Combined average ΔE for 3 colors | 28.5 | 22.2 |

TABLE 8

| 10 washing cycles | | | |
|---|---|---|---|
| | | Average Δe | |
| | Color | without cationic polymer | with cationic polymer |
| Test 1 | Black | 27.0 | 23.6 |
| Test 2 | | 28.3 | 23.3 |
| Test 3 | Blue | 7.2 | 6.0 |
| Test 4 | | 7.3 | 6.0 |

TABLE 8-continued

| 10 washing cycles | | | |
|---|---|---|---|
| | | Average Δe | |
| | Color | without cationic polymer | with cationic polymer |
| Test 5 | Red | 5.6 | 4.4 |
| Test 6 | | 6.3 | 5.5 |
| | Combined average ΔE for 3 colors | 40.9 | 34.4 |

The above tables show, hereto, a significant net reduction in the color variation ΔE when Jaguar® C-500 is combined with the washing powder and the Vanish® washing additive, compared to the use of the washing powder and the washing additive alone.

In the example 3 below, a Jaguar® C-500 cationic guar (molecular weight=300 000-500 000 $g \cdot mol^{-1}$; DS=0.08-0.11) was used in order to ensure the stabilization of the color of dyed cotton pieces during the machine washing thereof, in comparison with Jaguar® C-13S cationic guar (molecular weight: typically above 2 000 000 $g \cdot mol^{-1}$; Typical DS=0.13).

In order to do this, the cationic guar (C500 or C13S) was added to a detergent composition (X-TRA® washing powder) in a proportion of 1% by weight relative to the weight of the washing powder, then several successive cycles of washing fabrics based on dyed fibers using this additive-containing composition were carried out, under the conditions below.

These types of samples of dyed fabrics were subjected to the washing cycles, which fabrics are based on cotton fibers dyed by pigments, namely:

black on cotton: AISE 1 Sulphur Black red on cotton: AISE 16 Reactive Red blue on cotton: AISE 5 Vat Blue The washing cycles of these fabrics were carried out in a tergotometer, of the type that is standard in the field of the formulation of laundry products, especially detergent compositions. The machine simulates the mechanical and thermal effects of American pulsator type washing machines, but has 6 washing vessels (containers), which makes it possible to carry out series of simultaneous tests with a timesaving. The washing cycles were carried out under the following conditions:

Experimental Conditions

In each container of the tergotometer:

volume of tap water: 1000 ml 5 pieces of dyed fabrics (clean fabrics of the same color)

detergent composition: 5 g/l washing temperature: 40° C.

washing time: 30 minutes spinning: 100±3 cycles/min rinsing: two times 5 minutes at 20° C. in tap water drying conditions: at ambient temperature For each case, 10 successive washing cycles were carried out and the color change obtained for the fabrics was quantified at the end of the first, third, fifth and tenth cycle.

Measurement of the change was quantified using a KONICA Minolta CM-2600d spectrocolorimeter.

The color variation is quantified using the CIELAB (L*a*b*) scale and by measuring the color difference in terms of ΔL (lightness), Δa (red), Δb (yellow) according to a method that is well known per se, which makes it possible to attain the measurement of the total color difference ΔE (10°/illuminant D65), calculated as follows:

$$\Delta E=\sqrt{\Delta L^2+\Delta a^2+\Delta b^2}$$

where: $\Delta L=L_{after\ washing}-L_{before\ washing}$ $\Delta a=a_{after\ washing}-a_{before\ washing}$ $\Delta b=b_{after\ washing}-b_{before\ washing}$ The ΔE measurement reflects the change in the color during washing. The higher this value, the more pronounced the color difference.

Example 3: Comparison Between Jaguar® C500 and Jaguar® C13S Used in X-Tra Powder Tests were carried out with the red, blue and black colors and the results obtained after 1, 3, 5 and 10 washing cycles are indicated in tables 9, 10, 11 and 12 below.

TABLE 9

| 1 washing cycle | | | |
|---|---|---|---|
| | | Average Δe | |
| | Color | With Jaguar C500 | with Jaguar C13S |
| Test 1 | Black | 2.79 | 2.78 |
| Test 2 | Blue | 5.17 | 5.08 |
| Test 3 | Red | 0.99 | 1.06 |
| | Combined average ΔE for 3 colors | 8.96 | 8.92 |

TABLE 10

| 3 washing cycles | | | |
|---|---|---|---|
| | | Average Δe | |
| | Color | With Jaguar C500 | with Jguar C13S |
| Test 1 | Black | 5.95 | 6.22 |
| Test 2 | Blue | 6.36 | 6.61 |
| Test 3 | Red | 0.76 | 0.94 |
| | Combined average ΔE for 3 colors | 13.07 | 13.77 |

TABLE 11

| 5 washing cycles | | | |
|---|---|---|---|
| | | Average Δe | |
| | Color | With Jaguar C500 | with Jguar C13S |
| Test 1 | Black | 8.79 | 9.09 |
| Test 2 | Blue | 5.22 | 5.74 |

TABLE 11-continued

| 5 washing cycles | | | |
|---|---|---|---|
| | | Average Δe | |
| | Color | With Jaguar C500 | with Jguar C13S |
| Test 3 | Red | 1.30 | 1.41 |
| | Combined average ΔE for 3 colors | 15.31 | 16.23 |

TABLE 12

| 10 washing cycles | | | |
|---|---|---|---|
| | | Average Δe | |
| | Color | With Jaguar C500 | with Jguar C13S |
| Test 1 | Black | 13.99 | 14.53 |
| Test 2 | Blue | 6.41 | 6.72 |
| Test 3 | Red | 2.68 | 2.58 |
| | Combined average ΔE for 3 colors | 23.08 | 23.83 |

The above tables clearly show a reduction in ΔE when the washing powder is combined with Jaguar® C-500 compared to the use of Jaguar C13S.

The invention claimed is:

1. A method of reducing color loss from dyed cotton textile fibers after 3, 5 or 10 washing cycles, which fibers are based on cotton fibers dyed by pigments, comprising treating the textile fibers in an aqueous medium with a laundry product comprising 1% by weight of the laundry product of a cationic guar, wherein said cationic guar has an average molecular weight ranging from 300,000 to 500,000 g/mol and a degree of cationic substitution ranging from 0.08 to 0.11, and wherein the cationic guar comprises guar hydroxypropyltrimonium chloride.

2. The method of claim 1, wherein the cationic guar has a degree of cationic substitution ranging from 0.09 to 0.11.

3. The method of claim 1, wherein the concentration of the cationic guar in the aqueous medium ranges from 0.005 to 1 g/L.

4. The method of claim 1, wherein the laundry product comprises a detergent composition adapted for machine washing, optionally comprising a washing additive.

5. A method of making a laundry product comprising adding a cationic guar to the laundry product, wherein the laundry product reduces color loss from a dyed cotton textile fiber when said dyed cotton textile fiber is treated with the laundry product in an aqueous medium after 3, 5 or 10 washing cycles and wherein the cationic guar is added to said laundry product in an amount of 1% by weight, relative to the weight of the laundry product, wherein said cationic guar has an average molecular weight ranging from 300,000 to 500,000 g/mol and a degree of cationic substitution ranging from 0.08 to 0.11, and wherein the cationic guar comprises guar hydroxypropyltrimonium chloride.

* * * * *